US005099765A

United States Patent [19]

Czetto, Jr.

[11] Patent Number: 5,099,765

[45] Date of Patent: Mar. 31, 1992

[54] HIGH PENETRATION BULLET

[76] Inventor: Paul Czetto, Jr., 163 Cocoa Dr., Tavernier, Fla. 33070

[21] Appl. No.: 660,051

[22] Filed: Feb. 25, 1991

[51] Int. Cl.[5] ..... F42B 14/04

[52] U.S. Cl. ..... 102/511; 102/501; 102/514

[58] Field of Search ..... 102/511, 514-516, 102/501

[56] References Cited

U.S. PATENT DOCUMENTS

| | | | |
|---|---|---|---|
| 56,712 | 7/1866 | Cochran | 102/511 |
| 440,672 | 11/1891 | Wesson | 102/511 |
| 627,929 | 6/1899 | Andrews | 102/511 |
| 1,769,263 | 7/1930 | Johnson | 102/511 |
| 3,208,387 | 9/1965 | Giles | 102/511 |
| 4,961,382 | 1/1990 | Bai et al. | 102/511 |

FOREIGN PATENT DOCUMENTS

| | | | |
|---|---|---|---|
| 8218 | of 1885 | United Kingdom | 102/511 |

*Primary Examiner*—Harold J. Tudor
*Attorney, Agent, or Firm*—Larson and Taylor

[57] ABSTRACT

A high penetration bullet is provided which is made of lead and is of one piece construction. The nose of the bullet includes an outer nose portion, including an external, shaped (e.g., ogive) surface which gives the tip of the nose of the bullet its basic shape, and an inner nose portion including an internal, shaped (e.g., ogive) surface. The outer and inner nose portions are separated by a thin layer of a lubricant which is trapped between adjacent surfaces of the two nose portions when the stem or neck of an intermediate stage bullet element is peened over the inner nose portion during the formation of the outer nose portion. As a consequence of this construction, upon impact of the bullet with a target, the outer nose portion will decelerate and be impacted from behind by the trailing mass of the remainder of the bullet. This causes fragmenting or fracturing of the outer nose portion and exposes the lubricated, shaped internal surface of the inner nose portion which continues to penetrate deeper into the target. In one embodiment, a copper jacket is provided for the bullet apart from the outer nose portion.

7 Claims, 1 Drawing Sheet

HIGH PENETRATION BULLET

FIELD OF THE INVENTION

The present invention relates to high penetration bullets, i.e., bullets having the ability to penetrate deeply into targets including those which by nature or design tend to resist such penetration.

BACKGROUND OF THE INVENTION

Many different types of bullets have been made, and are currently being made, that are designed to increase the penetration of a bullet into a target. In general, the material, construction, shape or configuration, dimensions and other factors or parameters associated with prior art bullets have been varied in many different ways and in many different combinations in order to control the operational characteristics of the bullet (i.e., to control the effect that the bullet has on a target upon impact therewith), including the penetration power of the bullet. In this latter regard, many bullets have been specifically designed or constructed to travel at relatively high velocities and to provide deep penetration. Many such bullet constructions are relatively complex and require complicated, labor intensive manufacturing steps or techniques that raise the overall cost of manufacture.

In U.S. Pat. No. 4,938,147 (Czetto), granted on Jul. 3, 1990, I have disclosed a high impact expandable bullet which provides a number of important advantages over prior art bullets. That bullet is of multiple part construction and is specifically concerned with providing high impact forces and very substantial expansion upon hitting a target.

SUMMARY OF THE INVENTION

In accordance with the invention, a bullet is provided which produces substantially improved penetration upon impact as compared with prior art bullets. For example, as compared with the bullet constructions described in U.S. Pat. No. 4,938,147 referred to above, the bullet of the invention, while providing less expansion, produces much greater penetration. A further very important advantage of the bullet of the invention is that the bullet is relatively simple and easy to make. In this regard, the method of manufacture of the invention requires significantly fewer steps than does, for example, the method of manufacture of the bullet of my earlier patented invention.

In accordance with one aspect of the invention, a high penetration one piece lead or lead composition bullet is provided which comprises an integral lead or lead composition base and lead or lead composition nose, the nose including an outer nose portion including an external, shaped surface, and an inner nose portion including an internal, shaped surface and being separated, over a portion of the shaped surface thereof, from the outer nose portion by a thin layer of a lubricant such that, upon impact of the bullet with a target, the outer nose portion will decelerate and be impacted from behind by the trailing mass of the remainder of the bullet to thereby cause fracture or fragmenting of the outer nose portion and expose the lubricated, shaped internal surface of the inner nose portion which continues to penetrate into the target.

Preferably, the outer nose portion comprises a stem peened over the internal, shaped surface of the inner nose portion so as to form a relatively thin outer peripheral shell or skirt separated from the internal surface of the inner nose portion by the layer of lubricant, with the stem being joined centrally to the inner nose portion.

In an advantageous embodiment, the external, shaped surface is of an ogive shape and the internal, shaped surface is of a part ogive shape, although other shapes can also be used. The lubricant can be either a dry or a wet lubricant.

In one implementation of this aspect of the invention, the bullet includes an outer metal jacket. Preferably, the metal jacket covers the outer surface of the nose of the bullet apart from said external shaped surface of the outer nose portion, and also covers at least a major part of the outer surface of the base of the bullet. Further, the metal jacket preferably also covers at least part of the internal, shaped surface of the inner nose portion.

In accordance with a further aspect of the invention, a method is provided for making a high penetration bullet, the method comprising: shaping one end of a stock or beginning element made of lead or lead composition, such as a lead or lead composition core member or die blank or an existing lead or lead composition bullet, to form an intermediate stage bullet element comprising a base including a shaped (e.g., rounded or curved) shoulder portion and a stem projecting outwardly from the base centrally of the shaped shoulder portion; applying a lubricant to the intermediate stage bullet element; and forming a final stage, high penetration bullet by deforming and shaping said stem into an outer nose portion overlying the shaped shoulder portion in closely spaced relationship thereto but separated therefrom by a layer of the lubricant such that an upper part of the shaped shoulder portion forms an inner nose portion of the bullet. As mentioned above, when the bullet made by this method is fired, the outer nose portion will decelerate upon impact with a target and will be fragmented or fractured by the trailing mass of the remainder of the bullet so as to expose the lubricated inner nose potion which will continue to penetrate into the target.

The stem is preferably peened or flattened over said shoulder portion so as to form a relatively thin outer skirt or peripheral shell separated from the upper part of said shaped nose portion by the layer of lubricant. As noted above, the shaped shoulder portion is advantageously formed into an ogive shape and the shaped outer nose portion is advantageously formed into an ogive shape although other common bullet nose shapes can also be formed.

Preferably, the final forming step is such that the overall shape of the bullet, including the shape of the rest of the nose of the bullet in addition to the outer nose portion, is changed during this forming step, i.e., when the stem is peened over the shoulder portion.

In one implementation of this aspect of the invention related to that discussed hereinbefore, the intermediate stage bullet element is provided with an outer metal jacket during the formation thereof. Preferably, the metal jacket member is provided on the lead stock element and is formed, during the formation of the intermediate stage bullet element, into an outer metal jacket which covers the surface of the shaped shoulder portion and at least a major part of the outer surface of the base of the intermediate stage bullet element.

Application of the lubricant should be carried out so as to ensure that the lubricant will be trapped or captured between the adjacent surfaces of the inner and outer nose portions during the final forming step and in one embodiment, the lubricant is applied at least to the stem of the intermediate stage bullet element and in another, the lubricant is applied at least to the shoulder portion.

Other features and advantages of the invention will be set forth in, or apparent from, the detailed description of preferred embodiments of the invention which follows.

DESCRIPTION OF THE PREFERRED EMBODIMENTS

Figure 1:
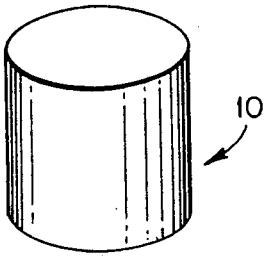
FIG. 1 is a perspective view of die blank or core used in making a high penetration bullet in accordance with a first embodiment of the invention.
Figure 2:
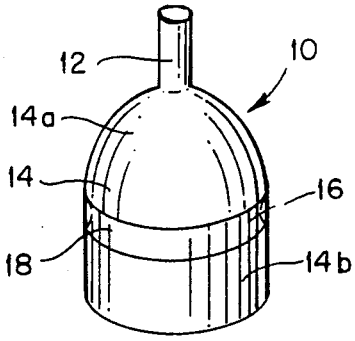
FIG. 2 is a perspective view of an intermediate stage bullet element formed from the black of FIG. 1 in accordance with a first forming or shaping step of the method of the invention.
Figure 3:
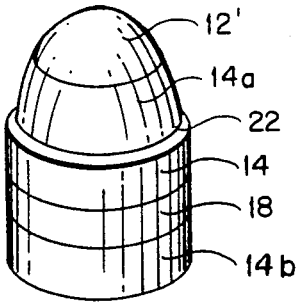
FIG. 3 is a perspective view of a finished or final stage bullet formed from the intermediate stage bullet element of FIG. 2 in accordance with a second forming or shaping step of the method of the invention.
Figure 4:
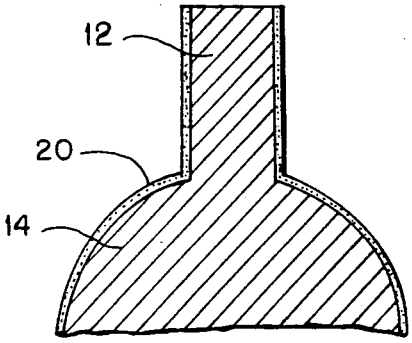
FIG. 4 is a schematic cross sectional view, drawn to an enlarged scale and partially broken away, of the intermediate stage bullet element of FIG. 2 showing a detail thereof.
Figure 5:
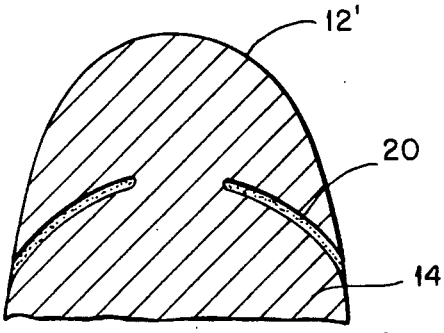
FIG. 5 is a schematic cross sectional view, drawn to an enlarged scale and partially broken away, of the final stage bullet of FIG. 3, showing a detail thereof.

Referring to FIGS. 1 to 3, there are shown three stage in the method of construction of a bullet in accordance with one preferred embodiment of the invention while FIGS. 4 and 5 shown details of FIGS. 2 and 3, respectively. In a preferred implementation, the bullet of this embodiment is made completely of lead or a lead composition and is of a one piece construction. FIG. 1 simply shows a standard bullet core or die blank, generally denoted 10, although it is to be understood that a production made lead or lead composition bullet (i.e., an existing lead bullet) could also be used as the beginning or starting bullet element. In the embodiment illustrated, the bullet core 10 is a simple cylinder.

FIG. 2 is a perspective view of the core 10 of FIG. 1 after being passed through a die press or the like so as to produce an intermediate stage bullet element having a relatively long stem or neck 12 extending outwardly (upwardly) from a base 14 formed by the remaining portion of the bullet 10. It is noted that an ordinary hand operated press can be used for this purpose and that alternatively this forming or shaping operation could also be readily automated. The base 14 is generally cylindrical but includes a rounded generally hemispherical upper portion **14*a* that provides a transition between the lower cylindrical portion 14*b* of base 14 and the neck or stem 12. The lower cylindrical portion 14*b* optionally includes a circumferential groove or cannelure indicated in dashed lines at 16 which, in the implementation illustrated, is filled with waxen material 18 or the like. For example, a mixture of bee wax, aloe and motor mica can be used for this purpose. The bullet element 10 formed at this stage is very similar to the core blank used to form the lower bullet part of the two-part bullet disclosed in my U.S. Pat. No. 4,938,147, granted Jul. 3, 1990 and referred to above. As illustrated in FIG. 4, which is a cross sectional detail of the bullet element of FIG. 2, the neck 12 and rounded shoulder portion 14*b* of the bullet element are covered with a lubricant 20. This lubricant 18** can be dry or wet and can comprise, for example, motor mica (a dry lubricant), a Corbin swage lubricant (a wet lubricant), or a "dip lube" made by Rooster Laboratories (a wet lubricant), among other examples of suitable commercially available lubricants.

Referring to FIG. 3, the finished or final stage product of this embodiment of the invention is shown. This final stage bullet 10 is produced by a second, and final, pass through the press or other shaping or forming device wherein the bullet 10 is swaged and the neck or stem 12 is peened over or otherwise flattened down and over the rounded shoulder portion **14*a* of base 14 and is provided with an ogive or other tapered, rounded, or pointed shaped nose. As a consequence, as is illustrated in FIG. 5, a layer of lubricant 20 is captured or trapped between the lower surface portions of the peened over stem 12' and the upper surface of shoulder portion 14*a* of base 14. As a result, a ring 22 is formed around the nose of the bullet and the corresponding surfaces mentioned above are spaced apart by the layer of lubricant 20 located therebetween. It is noted that the second swaging step is also used to provide some reshaping of upper portions of base 14 so that the bullet is of the shape illustrated in FIG. 3, i.e., comprises an ogive nose and cylindrical base separated by a very narrow stepped portion 22. It is important to understand that with this method of manufacture the nose of the bullet 10 is made up of an outer nose portion 12' formed by the peening over of stem 12, and the remainder of the nose next to the base and that the ogive shaped shoulder portion 14*a*** of what was the base forms a second, internal nose portion.

Figure 6:
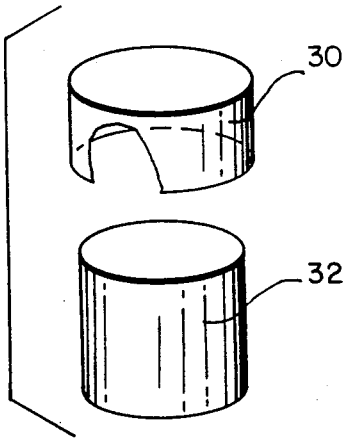
FIG. 6 is an exploded perspective view of blank or stock elements used in forming a jacketed bullet in accordance with a second embodiment of the invention.
Figure 7:
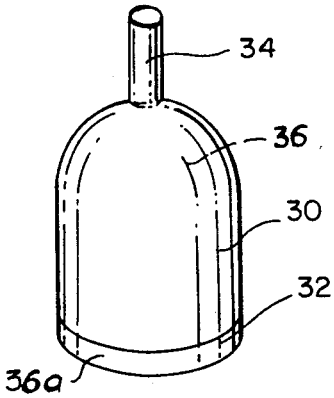
FIG. 7 is a perspective view, similar to that of FIG. 2, of an intermediate stage bullet element formed from the stock elements of FIG. 6.

The embodiment of FIGS. 6 to 10 is similar to that of FIGS. 1 to 5 except that a metal (preferably copper) jacket is used. Referring to FIG. 6, this metal jacket is formed using a cup shaped copper jacket member 30 which is shown partially broken away in FIG. 6 and which fits around one end of a cylindrical lead core or blank 32 similar to that of FIG. 1. A die press is then used to force a stem 34 through a jacket member 30 which thus forms a jacket 30 around core 32 as illustrated in FIG. 7. The shape of core 32 is the same as that of FIG. 3 (with the cannelure 16 and filler wax 18 omitted) except that, as shown, jacket 30 covers all of core 32 except for stem 34 and a bottom portion **36*a* of base 36**.

Figure 9:
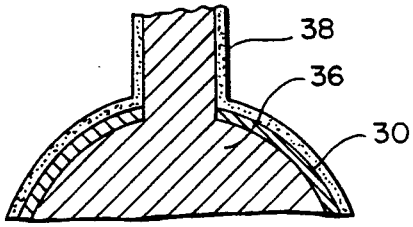
FIG. 9 is a schematic cross sectional view, drawn to an enlarged scale and partially broken away, of the bullet element of FIG. 7 showing a detail thereof.

As illustrated in FIG. 9, the stem 34 and the jacket 30 formed over base 36 are covered with a lubricant 38 as discussed above in connection with the first embodiment.

Figure 8:
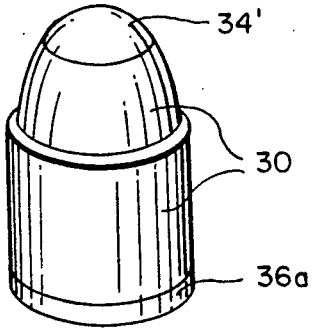
FIG. 8 is a perspective view, similar to that of FIG. 3, of a final stage bullet formed from the bullet element of FIG. 7.
Figure 10:
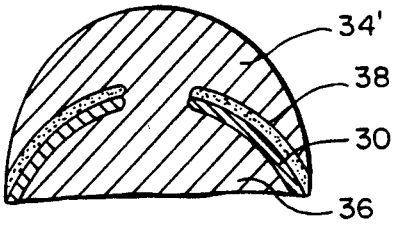
FIG. 10 is a schematic cross sectional view, drawn to an enlarged scale and partially broken away, of the bullet of FIG. 8 showing a detail thereof.

As illustrated in FIGS. 8 and 10, and similarly to the embodiment discussed previously, the stem or neck portion 34 is next peened over to form an outer nose 34' and, when this is done, a very thin layer of lubricant 38 is trapped or captured between nose 34' and jacketed base 36, as shown. Thus, apart from jacket 30, the embodiment of FIGS. 8 and 10 is very similar to that of FIGS. 3 and 5.

Turning now to a consideration of the "operation" of the bullet of the invention, and considering the embodiment of FIGS. 1 to 5 as exemplary, as set forth above, when the stem 12 is peened over or flattened down to form the outer ogive shaped nose of the bullet 10, the previously applied lubricant 20 is captured or locked in a layer between the newly formed outer nose portion 12' and a further inner nose portion formed by shoulder **14*a* of what was the base of the bullet, and, as a consequence, when the bullet impacts against a target, the outer nose portion 12' decelerates and is impacted from behind by the trailing mass of the bullet including the inner nose portion. As a result of this impact, the relatively thin and fragile leading nose portion 12' will fracture and fragment, and the remainder of the bullet, the new nose of which will be covered by lubricant 20, will penetrate into the target to a significantly greater degree than a conventional bullet. In other words, the outer nose portion 12' will break away and doing so will expose a new bullet nose, viz., the inner nose formed by the shoulder portion 14*a* of base 14 located adjacent to peened over stem 12', and this new nose will be at least partially covered by lubricant 20. In addition, the fragmenting nose portion 12'** will produce a substantial shock effect.

It will be appreciated that the "operation" of the bullet of FIGS. 8 and 10, i.e., the action of the metal jacketed bullet upon impact with a target, is basically the same as that of the bullet of FIGS. 3 and 5.

Although the present invention has been described relative to specific exemplary embodiments thereof, it will be understood by those skilled in the art that variations and modifications can be affected in these exemplary embodiments without departing from the scope and spirit of the invention.

What is claimed is:

1. A high penetration projectile comprising a one piece lead or lead composition bullet comprising a lead or lead composition base and an integral lead or lead composition nose, said nose including an outer nose portion, an inner nose portion, and a thin layer of a lubricant captured and retained in place between said outer nose portion and said inner nose portion, said outer nose portion including an external, shaped surface, and said inner nose portion including an internal, convex shaped surface separated from said outer nose portion by said thin layer of lubricant such that, upon impact of the bullet with a target, said outer nose portion will decelerate and be impacted from behind by the trailing mass of the remainder of the bullet to thereby fracture said outer nose portion and expose the lubricated, convex shaped internal surface of said inner nose portion which continues to penetrate into the target, said outer nose portion comprising a stem peened over the internal, convex shaped surface of said inner nose portion so as to form a relatively thin outer shell having a skirt portion separated from said internal surface of said inner nose portion by the thin layer of lubricant, said stem being joined centrally to said inner nose portion, said skirt portion having a concave internal surface, and said concave internal surface of said skirt portion overlying and conforming in shape to the internal, convex surface of said inner nose portion.

2. A bullet as claimed in claim 1 wherein said external, shaped surface is of an ogive shape and said internal, convex shaped surface is of an ogive shape apart from said stem.

3. A bullet as claimed in claim 1 wherein said lubricant consists of a single film of a dry lubricant.

4. A bullet as claimed in claim 1 wherein said lubricant consists of a single film of a wet lubricant.

5. A bullet as claimed in claim 1 wherein said bullet includes an outer metal jacket.

6. A bullet as claimed in claim 5 wherein said inner nose portion includes an outer surface, said base includes an outer surface, and said metal jacket covers the outer surface of said inner nose portion apart from said external shaped surface of said outer nose portion, and covers at least a major part of the outer surface of said base.

7. A bullet as claimed in claim 5 wherein said metal jacket covers at least part of the internal, convex shaped surface of said inner nose portion.

* * * * *